United States Patent [19]

Deuman, Sr. et al.

[11] Patent Number: 4,480,408

[45] Date of Patent: Nov. 6, 1984

[54] SELF-STORING DOOR

[75] Inventors: Gerald J. Deuman, Sr., Rte. 1, 10283 Hwy. 54, Amherst, Wis. 54406; Norman Sannes, Scandinavia, Wis.

[73] Assignee: Gerald J. Deuman, Sr., Amherst, Wis.

[21] Appl. No.: 486,302

[22] Filed: Apr. 18, 1983

[51] Int. Cl.[3] ..... E05D 15/58

[52] U.S. Cl. ..... 49/254; 49/258; 52/192; 52/196

[58] Field of Search ..... 49/254, 255, 258, 259, 49/250, 208, 256, 253; 52/192, 196; 312/323, 322

[56] References Cited

U.S. PATENT DOCUMENTS

| | | | |
|---|---|---|---|
| 157,100 | 11/1874 | Munzinger | 49/258 X |
| 1,130,307 | 3/1915 | MacCallum et al. | 49/253 |
| 1,139,244 | 5/1915 | Warren | 49/258 |
| 1,331,770 | 2/1920 | Hulen et al. | 49/253 |
| 4,262,447 | 4/1981 | Schneier et al. | 49/254 |
| 4,271,632 | 6/1981 | Vanderloop | 49/255 X |

*Primary Examiner*—Philip C. Kannan
*Attorney, Agent, or Firm*—Harvey B. Jacobson

[57] ABSTRACT

A door for closing the vertical opening in a silo wall which is self-storing thereby eliminating the necessity of removing the door through the base of the silo as the product is unloaded from the silo and eliminating the necessity of carrying the door up a ladder and inserting it into each vertical space before the silo is filled with silage or other crop product. The self-storing door includes a hinge structure attached to one side of the door opening with the hinge structure including a pair of horizontal, parallel supporting straps which are slidably connected with the vertical door to enable the door to swing and slide longitudinally on the straps sufficiently to enable it to be stored in an open position without the necessity of completely removing the door, lowering it to ground level and carrying it to a storage area for subsequent reinsertion in the vertical opening when the silo is being filled. The self-storing door may be used with a stave type silo with two steps being provided on each door to form a vertical ladder when all of the doors are in position or used in a concrete silo in which steps are already permanently installed. The door is recessed in the periphery of the vertical opening in order to prevent the door from sagging and provide a substantially flush inner surface to the silo to enable use of automatic silo unloaders which usually have some type of guide wheel structure rollingly engaging the inner surface of the silo.

8 Claims, 4 Drawing Figures

SELF-STORING DOOR

BACKGROUND OF THE INVENTION

1. Field of the Invention

The present invention generally relates to a silo door and more particularly a door which can be used in combination with vertical openings in a stave silo, concrete silo and the like in which the door is mounted for pivotal movement and limited sliding movement horizontally so that the door can be self-storing and left in position when unloading a silo using automatic silo unloaders and the like and can be securely latched in closed position when filling the silo thereby eliminating the necessity of lowering and storing the silo doors when unloading a silo and lifting and reinserting the silo doors when the silo is being refilled.

2. Description of the Prior Art

Silo doors to close a vertical opening or openings in a silo wall are generally well known and conventionally, such doors are placed in the vertical opening when the silo is being filled and when the silo is being unloaded, these doors are removed and lowered to ground level and stored in a storage area. As can be appreciated, this requires considerable labor and time. The following U.S. patents disclose various silo door structures and other closures, such as gates and the like, which are relevant to this invention.

U.S. Pat. No. 288,601
U.S. Pat. No. 964,545
U.S. Pat. No. 1,126,653
U.S. Pat. No. 1,130,307
U.S. Pat. No. 1,162,022
U.S. Pat. No. 1,642,003
U.S. Pat. No. 3,997,025
U.S. Pat. No. 4,118,909
U.S. Pat. No. 4,271,632

Several of the above patents disclose closure doors for silo structures some of which are removable and some of which are hingedly supported from the silo. However, none of the above patents discloses the specific structure of this invention.

SUMMARY OF THE INVENTION

An object of the present invention is to provide a self-storing silo door attached to the vertical edge of a vertical opening in a silo wall by a hinge and horizontal slidable assembly which enables the door to swing about a generally vertical axis and move horizontally away from the hinge axis to enable the door to swing to an open position about an axis oriented in radially spaced relation to the inner and outer surface of the silo wall so that the door may be opened and left in position and will not interfere with an automatic silo unloader associated with the vertical opening in the silo.

Another object of the invention is to provide a self-storing door which may be used with various types of silos including a concrete silo, a stave silo and the like which is recessed in the inner wall surface of the silo to provide a substantially smooth interior silo surface for association with automatic silo unloaders and the like.

A further object of the invention is to provide a self-storing door in accordance with the preceding objects in which the door may be provided with a step to provide a climbing ladder when a plurality of doors have been assembled with a plurality of openings in the silo wall or the door may be used with a concrete silo having permanent steps already incorporated in the vertical wall opening.

Still another object of the invention is to provide a self-storing door which is long lasting and rugged in construction, easy to latch and unlatch and move from a closed position to an open position when unloading the silo and easily moved from an open position to a closed position when the silo is being filled with ensilage or the like.

A still further object of the invention is to provide a self-storing silo door which can be used in new silo construction or used as a replacement for presently used silo doors which are not self-storing and is relatively inexpensive to manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
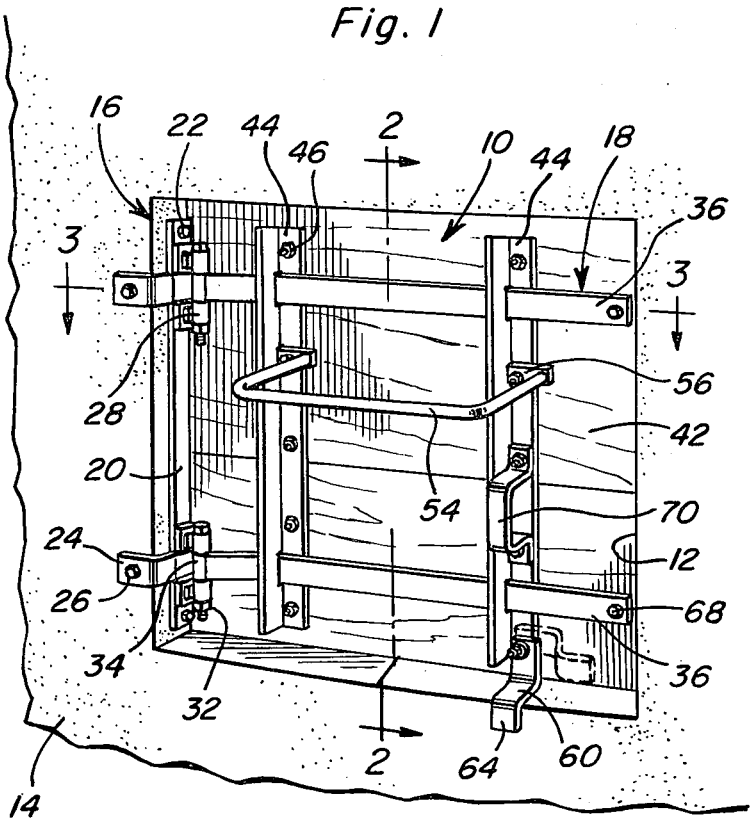
FIG. 1 is a perspective view of a silo wall with a vertical opening therein having the self-storing door of the present invention installed therein.

Referring now specifically to the drawings, the self-storing door of the present invention is generally designated by the numeral 10 and is installed in a vertical opening 12 in the peripheral wall 14 of a silo with the door 10 forming a closure for the opening 12 when in closed position with the silo door 10 being in closed position when the silo is being filled and remaining in closed position until the silo is unloaded. As the silo is unloaded, the vertically oriented doors 10 are successively opened and are normally removed and lowered to ground level and placed in a storage area until they are again ready to be used. In the present invention, the door 10 is supported by a hinge structure generally designated by numeral 16 along one vertical edge of the opening 12 and by supporting straps 18 connected to the hinge structure and slidably connected to the door 10 in a manner set forth hereinafter.

Figure 2:
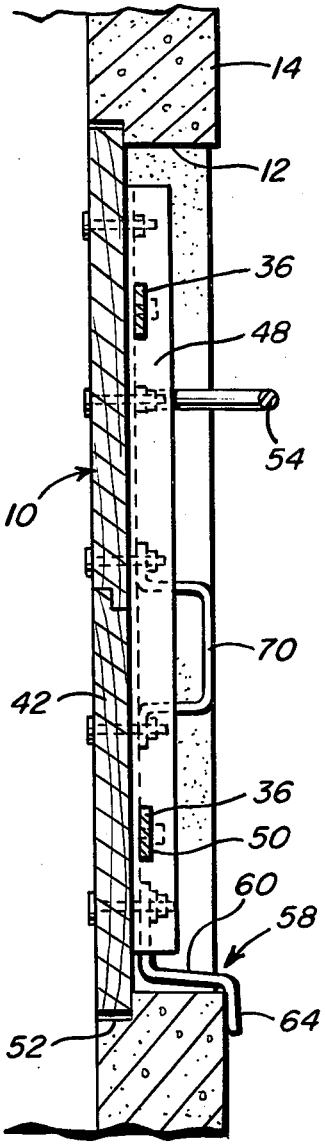
FIG. 2 is a vertical sectional view, on an enlarged scale, taken substantially upon a plane passing along section line 2—2 of FIG. 1 illustrating further structural details of the door and its association with the vertical opening in the silo wall.
Figure 4:
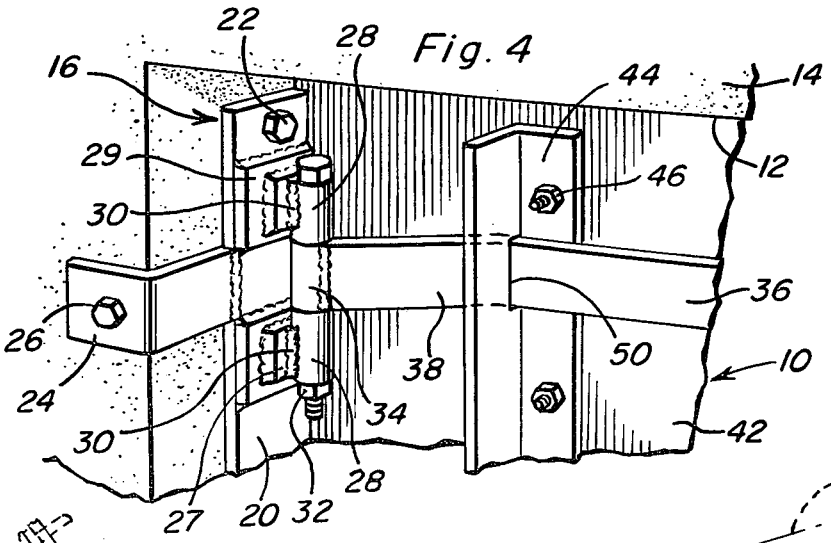
FIG. 4 is an enlarged fragmental perspective view of the upper corner of the door and silo wall opening illustrating the manner in which the supporting structure for the door is associated with the door and silo wall opening.
Figure 3:
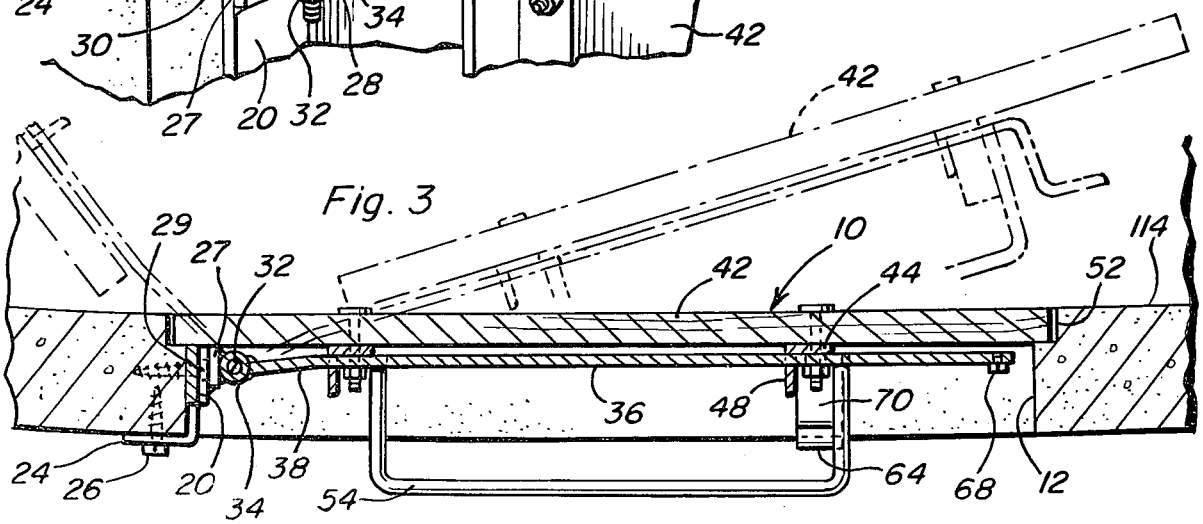
FIG. 3 is a horizontal sectional view taken substantially upon a plane passing along section line 3—3 of FIG. 1 illustrating the structural details of the hinge and slide structure for the self-storing door.

As illustrated, the hinge assembly 16 includes a vertical frame member 20 in the form of a bar extending along the inner surface of one vertical edge of the opening 12 and secured to the silo wall 12 by fastening devices such as bolts 22. The bar 20 includes a pair of vertically spaced right angular straps 24 extending to the outer surface of the wall 14 and along a portion of the outer surface of the wall 14 as illustrated in FIG. 4 with the straps 24 also being secured to the silo wall 14 by bolts 26 and the like. Fixedly attached to the vertical frame 20 is a plurality of hinge barrel elements 28 supported by spacer blocks 27 and 29 secured to the outer surface of the bar 20 and to each other by welding 30 or the like with the hinge barrel elements 28 being oriented in pairs and in vertical alignment with one pair adjacent the upper end of the bar 20 and the other pair adjacent the lower end of the bar 20 as illustrated in FIG. 1. A hinge bolt 32 extends downwardly through each pair of hinge barrel elements 28 and through a hinge barrel element 34 interposed between and aligned with the hinge barrel elements 28 as illustrated in FIG. 4. The hinge barrel element 34 is at one end of one of the elongated straps 18 each of which are in the form of a bar or strap 36 of rectangular cross sectional configuration as illustrated in FIG. 2 and provided with an offset end portion 38 on which the hinge barrel element 34 is mounted as by welding 40 or the like. This structure is best illustrated in FIGS. 3 and 4 so that the straps 36 are hingedly attached to the supporting frame 20 for swinging movement about a vertical axis defined by the hinge bolts 32.

The door includes a rigid panel 42 which may be a single wood member or a plurality of wood members which may be connected along a horizontal line by a shiplap joint or the like. Attached to the outer surface of the door panel 42 is a pair of vertically elongated angle iron members 44 secured to the door as by the use of elevator bolts 46 having the circular head against the inner surface of panel 32. Each member 44 has an outwardly extending flange 48 with each of the flanges 48 including a pair of slots 50 where the flange 48 has it juncture with the flange of the angle iron member 44 that is attached to the door panel 42. With this construction, the door 10 may slide horizontally and longitudinally along the straps 36 when the door is in open position which enables the door panel 42 to move to the dotted line position when it is swung towards an open position as illustrated in FIG. 3. With this construction, the door panel 42 may move inwardly from the recessed inner edge 52 of the vertical opening 12 and move longitudinally on the supporting straps 36 to a completely open position with the inner edge of the door panel 42 not contacting the inside surface of the silo wall 14 until the door panel 42 has reached a fully opened position as illustrated to the left of FIG. 3.

When using the self-storing door 10 in a concrete silo, the door 10 is provided with a step 54 in the form of a generally U-shaped rigid rod having flanges 56 at the inner ends of the legs thereof which are positioned under one of the bolts 46 on each of the angle iron members 44. Thus, a person desiring to climb the silo wall may use the steps 54 in a conventional and well known manner. In stave silos, each door will have two steps of U-shaped iron strap similar in configuration to the rod step shown in the drawings.

A latch structure 58 is provided on the door 10 adjacent the bottom portion thereof to engage with the periphery of the opening and is in the form of an angulated member 60 having an end portion 62 secured to the door panel 42 by one of the bolts 46 with the latch 60 also including a flange 64 which engages the periphery of the opening 12 in opposed relation to the recess 52. The latch can be pivoted about the axis of the pivot bolt 46 from its latched position to its unlatched position. When the door is in closed position, it is positioned within the recess 52 in the opening 12 of the wall of the silo so that the inner surface of the door panel 42 is generally flush with the inner surface of the silo wall thereby enabling automatic silo unloading equipment to be used with the door. Also, the support of the periphery of the door in the recess 52 prevents the door from sagging due to the weight of persons climbing the ladder formed by the steps 54 and also prevents sagging of the door due to its own weight when it is in closed position. Also, as illustrated, the outer ends of the straps 36 are provided with fastener bolts 68 or the like which serve as limit stops to prevent the angle iron members 44 and the door panel 42 from sliding off the ends of the supporting straps 36 when the door panel 42 is moved to the open position and slid horizontally to the maximum position permitted as illustrated in the broken line illustration in FIG. 3. Also, a handle 70 is mounted on one of the angle iron members 44 to facilitate movement of the door.

The structure of the door is variable as to size and dimensions depending upon the dimensional requirements of the vertical opening in the silo wall and the door can be easily opened as the silo unloader unloads the silo from the top in a conventional manner and swung and slid to an open position and a plurality of the doors are successively opened until the unloading of a silo is complete. When the silo is filled, the doors can be successively closed by merely swinging and sliding the doors so that they are aligned with and positioned in the recess 52 in the opening 12. The doors may be constructed with or without a step mounted thereon and may be constructed so that the door can be swung either inwardly or outwardly although it is preferred for the door to be positioned inwardly and swung inwardly to the fully opened position as illustrated in the left hand portion of FIG. 3.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A silo door positionable in a closed position to close a vertical opening in the wall of a silo and in an open position enabling material to be unloaded from the silo through the opening, said silo door including a door panel of a dimension to fit closely within and close the opening in the silo wall to provide a flush interior surface to the door panel and silo, a hinge and slide assembly supporting the door panel for movement between a closed position and an open position with the hinge and slide assembly including a hinge structure enabling pivotal movement of the door panel about a generally vertical axis disposed radially outwardly of the inner surface of the silo and a slide assembly slidably supporting the door panel from the hinge structure to enable the door panel to be slid horizontally laterally in relation to the vertical axis to enable the edge of the door panel adjacent the vertical axis to move away from the vertical axis when moving toward open position and towards the vertical axis when moving toward the closed position.

2. The structure as defined in claim 1 wherein said slide assembly includes a pair of rigid straps extending along the outer surface of the door panel, a pair of vertical flanges rigid with the door panel and including slots slidably receiving the straps, said straps including means on the outer ends thereof to retain the flanges and door on the straps.

3. The structure as defined in claim 2 wherein said hinge structure includes a vertical frame member secured to the vertical edge of the silo wall opening, a plurality of pairs of hinge barrels secured to the frame member, each of said straps including a hinge barrel interposed between the pair of hinge barrels with the barrels being aligned and receiving a pivot bolt to form a vertical axis between the vertical frame member and the straps.

4. The structure as defined in claim 3 wherein said door panel is dimensioned to fit within a recess within the inner edge of the silo wall opening to provide a flush interior surface to the silo and door panel when the door panel is in closed position to enable automatic silo unloading machinery to be used with the door.

5. The structure as defined in claim 4 together with a latch structure mounted on the door panel to engage a portion of the periphery of the sidewall opening to retain the door panel in closed position within the recess in the silo wall opening, said latch structure including a pivoted member having a flange engaging the outer surface of the silo wall in a latched position and positioned inwardly of the periphery of the silo wall opening in a released position to selectively secure the door in closed position, and a generally U-shaped rigid step member having parallel legs attached to the outer surface of the door panel to form a ladder when a plurality of door panels are oriented in closed position.

6. The structure as defined in claim 5 wherein each of said rigid straps includes an inclined portion having the hinge barrel thereon to space the vertical axis laterally outwardly of the recess receiving the door panel, said vertical frame member secured to the vertical edge of the silo wall opening spacing the vertical axis laterally from the periphery of the opening whereby reception of the door panel in the recess precludes sliding movement thereof when in closed position and the positioning of the vertical axis requires radial outward movement of the door panel in relation to the vertical axis when the edge of the door panel remote from the vertical axis is swung outwardly of the recess with the positioning of the vertical axis, wall opening and recess enabling the straps and the door panel thereon to be swung through an arc greater than 90°.

7. In combination with a silo wall having an opening therethrough, said wall being constructed of cementitious material and said opening including a recess at the inner edge thereof, a door panel dimensionally constructed to closely fit within the recess and form a closure for the opening, said door panel having a generally smooth interior surface flush with the inner surface of the silo wall to enable rolling wheel means on automatic silage handling without interference from unevenness, a pair of vertically disposed angle iron members mounted rigidly on the outer surface of the door panel, each angle iron member extending substantially throughout the height of the door panel and including a vertically disposed outwardly extending flange, a pair of elongated horizontally disposed support straps positioned adjacent the outer surface of the door panel in perpendicular relation to the vertical flange, each of said vertical flanges having a slot adjacent its inner edge slidably receiving said strap, hinge means pivotally supporting one end of each strap from the wall opening, the other end of each strap having projecting means thereon in spaced relation to the adjacent slot when the door panel is in closed position in the recess and preventing said other end of the strap from passing completely through the adjacent slot thereby retaining the door panel on the straps while permitting the door panel to be slid toward the projecting means when swung toward open position out of the recess, said hinge means including a pair of vertically spaced hinge structures, each hinge structure comprising a vertical hinge pin, a hinge barrel on said one end of said strap received on said hinge pin, a mounting bracket secured to the silo wall opening, a hinge barrel mounted on said bracket and received on said hinge pin to enable pivotal movement of the straps and door panel about a vertical axis defined by the hinge pins, said hinge pins and barrels being spaced laterally outwardly of the recess and radially inwardly of the wall opening thereby causing the door panel to slide along the straps when pivoting between closed and open positions.

8. The combination of claim 7 wherein said mounting bracket includes an elongated vertical bar rigidly affixed to the inner surface of the wall opening with said hinge barrels mounted thereon, each strap having an inclined end portion having the hinge barrel thereon, said vertical bar including a pair of vertically spaced angular straps extending to and along a portion of the outer surface of the silo wall, means anchoring said pair of angular straps to the outer surface of the silo wall, said door panel being precluded from sliding movement on the straps while received in the recess until the edge thereof remote from the hinge pins is swung out of the recess.

* * * * *